US008368526B2

(12) United States Patent
Chalk

(10) Patent No.: US 8,368,526 B2
(45) Date of Patent: Feb. 5, 2013

(54) SELF-MONITORED HOME SECURITY SYSTEM USING MOBILE COMMUNICATIONS

(75) Inventor: Mark Chalk, Fort Wayne, IN (US)

(73) Assignee: CenturyLink Intellectual Property LLC, Denver, CO (US)

( * ) Notice: Subject to any disclaimer, the term of this patent is extended or adjusted under 35 U.S.C. 154(b) by 329 days.

(21) Appl. No.: 12/433,381

(22) Filed: Apr. 30, 2009

(65) Prior Publication Data

US 2010/0279664 A1 Nov. 4, 2010

(51) Int. Cl.
*G08B 29/00* (2006.01)

(52) U.S. Cl. ..... 340/506; 340/539.22; 340/541; 455/462; 116/75; 182/18

(58) Field of Classification Search ..... 340/517, 340/539.22, 531, 5.61, 506, 539.11; 455/462, 455/414.1; 379/42

See application file for complete search history.

(56) References Cited

U.S. PATENT DOCUMENTS

| | | | | |
|---|---|---|---|---|
| 5,543,778 | A * | 8/1996 | Stouffer | 340/539.14 |
| 6,049,273 | A * | 4/2000 | Hess | 340/539.11 |
| 6,400,265 | B1 * | 6/2002 | Saylor et al. | 340/531 |
| 6,624,750 | B1 * | 9/2003 | Marman et al. | 340/506 |
| 6,661,340 | B1 * | 12/2003 | Saylor et al. | 340/517 |
| 6,778,084 | B2 * | 8/2004 | Chang et al. | 340/541 |
| 6,864,789 | B2 * | 3/2005 | Wolfe | 340/539.1 |
| 6,999,562 | B2 * | 2/2006 | Winick | 379/42 |
| 7,042,353 | B2 * | 5/2006 | Stilp | 340/539.22 |
| 7,119,658 | B2 * | 10/2006 | Stilp | 340/5.61 |
| 7,129,830 | B2 * | 10/2006 | Hager et al. | 340/500 |
| 7,174,176 | B1 * | 2/2007 | Liu | 455/462 |
| 7,248,157 | B2 * | 7/2007 | Bergman et al. | 340/531 |
| 2003/0104800 | A1 * | 6/2003 | Zak | 455/404 |
| 2009/0207031 | A1 * | 8/2009 | Barth et al. | 340/605 |

* cited by examiner

*Primary Examiner* — Kent Chang

*Assistant Examiner* — Benjamin Morales Fernandez

(74) *Attorney, Agent, or Firm* — Swanson & Bratschun, L.L.C.

(57) ABSTRACT

A system and method for providing home security services may include receiving, at a local alarm controller, a cordless sensor signal indicative of an alarm sensor being triggered. The cordless sensor signal may be communicated over one of multiple cordless telephone channels. In response to receiving the sensor signal, a signal indicative of the cordless telephone channel may be communicated to a mobile telephone of a user to notify the user that a sensor associated with the cordless telephone channel was triggered.

14 Claims, 4 Drawing Sheets

SELF-MONITORED HOME SECURITY SYSTEM USING MOBILE COMMUNICATIONS

BACKGROUND

Home security systems typically have sensors distributed throughout a home or property. The sensors are generally in communication with a local alarm controller via wired and/or wireless communications interfaces. Local alarm controllers generally communicate over the public switched telephone network (PSTN) or a mobile telephone network. The local alarm controller, in response to receiving a sensor signal indicating that the sensor sensed a breach (e.g., motion, opening of a window, pressure or force on a pressure sensor), communicates an alarm signal to a central monitoring station. To communicate the alarm signal, the local alarm controller performs a speed-dial to the central monitoring station, and can communicate data to the central monitoring station. The central monitoring station typically has human operators who are notified of the alarm signal, which may indicate the specific area of a house or property that was breached. The operator will contact an owner of the property and/or police in response to reviewing the alarm signal. A problem that exists with conventional alarm systems is that a monthly service fee is typically required for a user to pay for the monitoring service to be performed. Often, the monthly service fee can dissuade potential customers to install or activate a home security system.

A problem that exists for wireline telephone carriers is the mass exodus of customers. Recent statistics have shown that thousands of customers per day have been dropping their wireline telephone service as mobile telephone services and broadband telephone services have become pervasive throughout society. Wireline telephone carriers desire to reverse the trend of losing customers. One such way is to provide services that can save customers money by eliminating monthly home security monitoring fees, but provide home security for its customers.

SUMMARY

To overcome the problem of having an alarm company perform monitoring services for a monthly service fee and provide customers with home security monitoring capabilities, the principles of the present invention provide for self-monitoring of a home security system by configuring a local alarm controller to call or send a message to a wireless communications device of a user or network node that is configured to dial or message the wireless communications device. In one embodiment, the local alarm controller may be built into a cordless telephone base unit or an independent device that may utilize up to 25 frequency bands in a cordless frequency range. Each frequency band may be associated with a different sensor, thereby providing a user up to 25 sensors that may be utilized to monitor a home. The local alarm controller may receive a sensor signal over a frequency band on which a sensor is operating and place a call or send a message to a wireless communications device of a user. In one embodiment, the local alarm controller may be configured with up to 25 telephone numbers from which the local alarm controller can use to place a call. Alternatively, the local alarm controller may be configured to call a network node using one of up to 25 telephone numbers that, in response to receiving an alarm signal from the local alarm controller, may call the wireless communications device such that the wireless communications device receives a caller ID with a certain number that is indicative of the sensor that was triggered. In an alternative embodiment, the local alarm controller may call the network node and send a sensor identification signal to identify the particular sensor that was triggered to cause the network node to call the wireless communications device with a telephone number that indicates which sensor was triggered. In another embodiment, the local alarm controller or network node may be configured to send a message, such as a text message, to the wireless communications device to indicate which sensor was triggered. While being able to specifically identify which sensor was triggered, the principles of the present invention also provide for calling or messaging a wireless communications device to notify the user that a sensor of the home security system was triggered without identifying which sensor in particular was triggered.

One embodiment of a method for providing home security services may include receiving, at a local alarm controller, a cordless sensor signal indicative of an alarm sensor being triggered. The cordless sensor signal may be over one of multiple cordless telephone channels. In response to receiving the sensor signal, a signal indicative of the cordless telephone channel may be communicated to a mobile telephone of a user to notify the user that a sensor associated with the cordless telephone channel was triggered.

One embodiment of a home security system may include at least one sensor configured to communicate over respective different cordless telephone channels. A local alarm controller may be configured to communicate with the sensor(s) over the different cordless telephone channels and communicate with a wireless communications device via a communications network in response to receiving a sensor signal from one of the sensors.

One embodiment of a network node for providing home security services may include an input/output (I/O) unit configured with multiple I/O modules, where each of the I/O modules may be configured to communicate over a communications network, and a processing unit. The processing unit may be configured to, in response to receiving a communication from a local alarm controller via the I/O unit, communicate with a wireless communications device of a user via one of the I/O modules.

BRIEF DESCRIPTION

DETAILED DESCRIPTION

Figure 1:
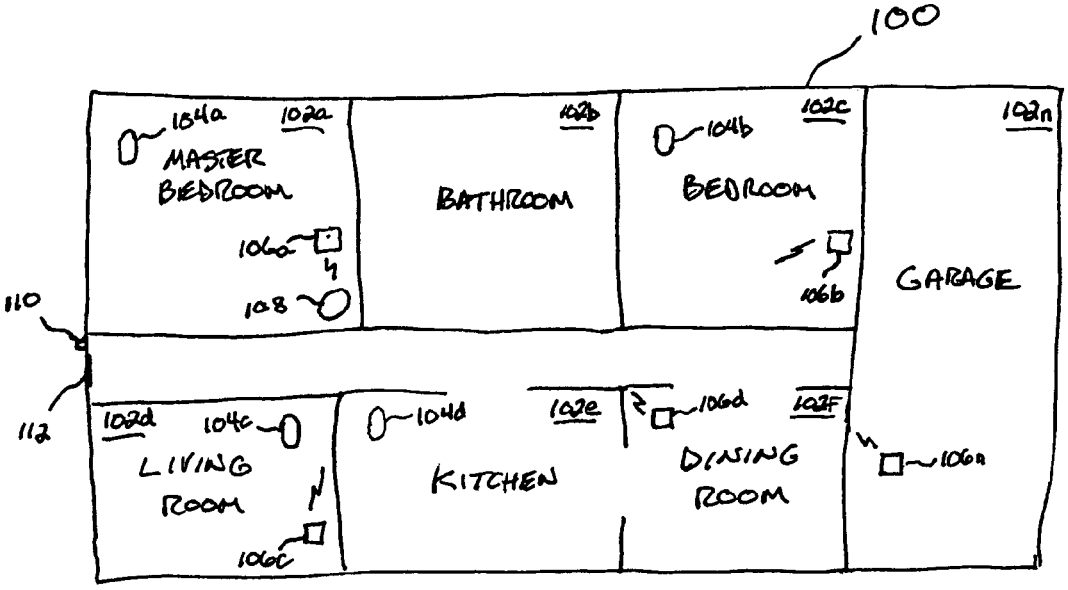
FIG. 1 is an illustration of an illustrative residence in which a home security system may be utilized in accordance with the principles of the present invention.

With regard to FIG. 1, an illustrative residence 100 that includes a number of different rooms or areas 102*a*-102*n* (collectively 102) is shown. A resident of the residence 100 may place telephones 104*a*-104*n* (collectively 104) in one or more of the rooms 102. The telephones 104 may be wired telephones or cordless telephones. Cordless telephones, as understood in the art, include a handset that wirelessly communicates with a base unit using radio waves. The radio waves are allocated by the Federal Communications Commission (FCC) and may operate in a number of different frequency bands, including 900 MHz (902-928 MHz), 1.9 GHz (1880-1900 MHz), 2.4 GHz and 5.8 GHz. Each of these frequency bands allow for up to 25 frequency channels or more on which a cordless handset may communicate with the base unit.

In one embodiment, one or more sensors 106*a*-106*n* (collectively 106) may be disposed throughout the residence 100 in one or more different rooms 102. The sensors 106 may be wired or cordless. If cordless, the sensors 106 may operate over one or more of the cordless communications channels within a given frequency range, as previously described. The sensors 106 may each be configured to operate over a different cordless channel so that a user may be able to readily identify in which room 102 a respective sensor has been triggered. For example, each of the sensors 106 may operate in a unique one of up to 25 different frequencies, thereby enabling the home security system to utilize up to 25 different sensors to detect that a breach has occurred in one or more of the different rooms 102 of the residence 100. A local alarm controller 108 may be configured to communicate with each of the different sensors 106 that are located throughout the residence 100, and be configured to communicate with each of the sensors 106 over different, respective cordless frequencies or channels. In one embodiment, the local alarm controller 108 may be integrated into a cordless telephone or be a separate device that operates on a telephone network that is connected to the residence 100. For example, the communications network may be the public switched telephone network (PSTN). By configuring the local alarm controller 108 to utilize the PSTN, a wireline telephone service provider may maintain and attract more customers.

An alarm indicator display 110 may be in communication with the local alarm controller 108 and positioned externally from the residence 100. The alarm indicator display 110 may be configured to receive an alarm signal from the local alarm controller 108 if one of the sensors 106 is triggered. In one embodiment, the alarm indicator display 110 may be configured to identify that an alarm has been triggered by one of the sensors. Alternatively, the alarm indicator display 110 may be configured to display which of the sensors 106 has been triggered. The alarm indicator display 110 may be configured as a display with a green/red LED, as understood in the art. Alternatively, the alarm indicator display 110 may be a digital display (e.g., LED, LCD, or otherwise) that is capable of displaying a number representative of a sensor (e.g., "ALARM ON," "ALARM OFF," "ALARM TRIGGERED," "SNSR 1," "MSTR B DRM," etc.). The alarm indicator display 110 may be configured within a box or behind a flap to limit view thereof. By positioning the alarm indicator display 110 externally from the residence 100, a resident can view the alarm indicator display 110 prior to entering the residence 100 to ensure that the residence is safe to enter. The alarm indicator display 110 may be useful to a resident should he or she no have a mobile telephone available to determine whether the alarm has been triggered by an unauthorized person and that person still be in the residence 100.

Figure 2:
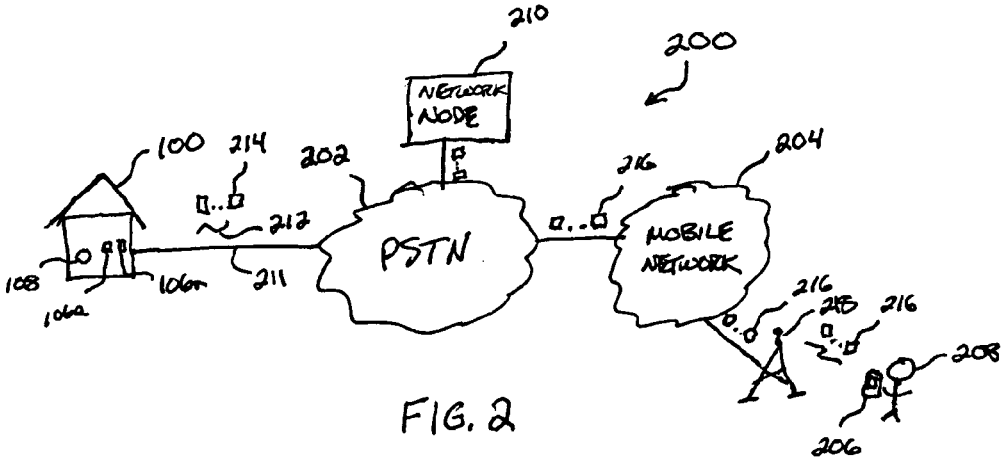
FIG. 2 is an illustration of an illustrative network environment in which the home security system of FIG. 1 may be utilized to notify a user of a breach of his or her residence.

With regard to FIG. 2, an illustration of an illustrative network environment 200 is shown. The network environment 200 may include the residence 100 of FIG. 1 that is receiving telecommunications services via the PSTN 202. In accordance with the principles of the present invention, the local alarm controller 108 may be configured to communicate with a wireless communications device 206 of a user 208 who resides at the residence 100. In being configured to communicate with the mobile communications device 206, the local alarm controller 108 may store a telephone number of the wireless communications device 206 or other address (e.g., e-mail address, instant message address, text message address, or otherwise) to notify the user 208 when a sensor 106 in the residence 100 is triggered by an intruder entering the premises of the residence 100 without authorization.

A network node 210 may be in communication with the PSTN 202 and be configured to operate in conjunction with the local alarm controller 108 to provide for the home security services functionality in accordance with the principles of the present invention. The network node 210, in one embodiment, may provide for various functions that assist the local alarm controller 108 or take the place of functionality that may save cost for including the functionality in the local alarm controller 108. For example, the network node 210 may be configured to enable a user to receive notice that one of the sensors 106 has detected a breach of the residence 100. In response to the network node 210 receiving information from the local alarm controller 108 that one of the sensors 106 has been triggered, the network node 210 may access location information of the particular sensor as established by the user and communicate the location of the sensor that has been triggered to the wireless communications device 206 in an audible or textual format.

The local alarm controller 108, which may be incorporated into a telephone or separate device, may communicate over a communications line 211 with an analog signal 212 and/or data signal 214 that includes information indicative of a sensor being triggered. In one embodiment, the information may include a specific sensor number, indicator of a room in which the sensor is located, and telephone number or address to which the information is to be communicated to the wireless communications device 206. If the local alarm controller 108 is configured to communicate directly with the wireless communications device 206 as opposed to first communicating with the network node, then the data may be communicated via the PSTN 202 and mobile network 204 in data packets 216, which may be identical to the data packets 214 or include data converted from the analog signal 212 into data packets 216 by the network node 210, for example. The data packets 216 may be communicated via an antenna 218 local to the wireless communications device 206. The wireless communications device 206 may receive the data packets 216 and alert the user 208 of reception thereof. If the data packets 216 are in the form of a telephone call, the wireless communications device may display a caller ID indicating that the call is coming from the residence 100, thereby alerting the user 208 that the call may be from the local alarm controller 108. If the local alarm controller 108 is configured with multiple telephone numbers and able to communicate over multiple, respective telephone lines, then each of the telephone numbers may be assigned to a different sensor, thereby enabling the user 208 to set up a contact list within the wireless communications device 206 so that a call from any of the telephone lines or numbers from the local alarm controller 108 may cause the wireless communications device 206 to display for the user 208 the particular sensor that is triggering the local alarm controller 108. If the network node 210 is configured with multiple telephone lines as opposed to the local alarm controller 108 being configured to communicate over multiple telephone lines, then, the network node 210 may, in response to receiving an indication of a particular sensor from the local alarm controller 108 that is triggering the local alarm controller 108, call the wireless communications device 206 on the appropriate or associated telephone line that indicates to the wireless communications device 206 of the particular sensor that has been triggered (e.g., "master bedroom"). In other words, the user may establish a contact list having sensor locations and associated telephone numbers within the wireless communications device 206 that displays a sensor name when an associated telephone number is used to call the wireless communications device 206.

Figure 3:
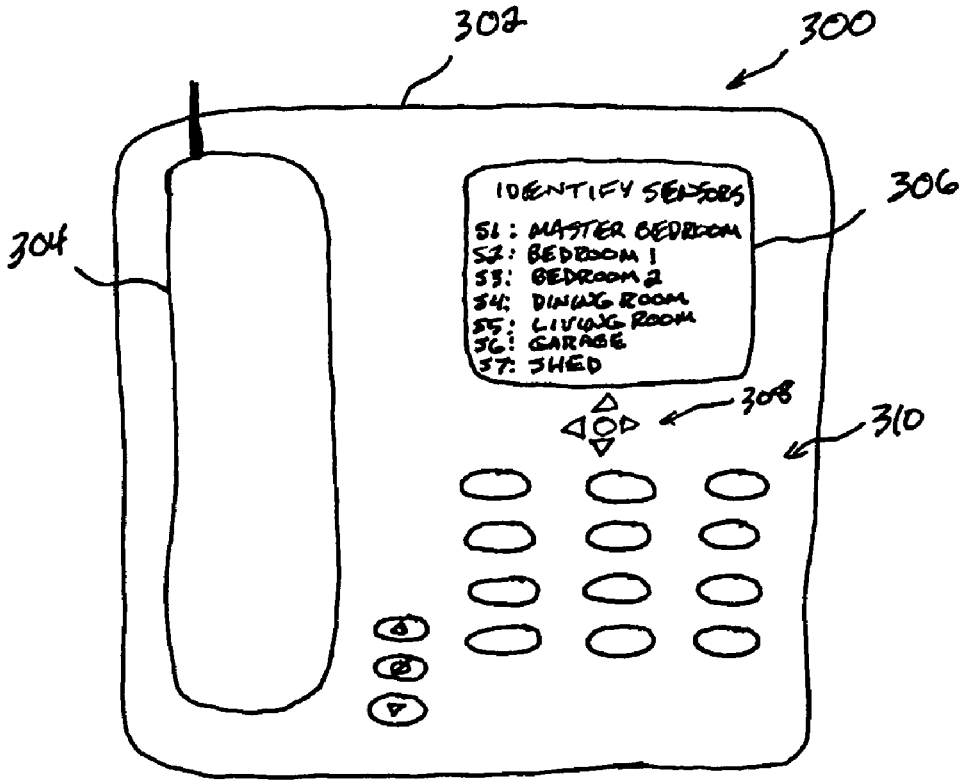
FIG. 3 is an illustration of an illustrative cordless telephone in which a local alarm controller may be integrated.

With regard to FIG. 3, an illustrative cordless telephone 300 is shown to include a base unit 302 and cordless handset 304. The cordless handset 304 may be utilized to wirelessly communicate with the base unit 302 during a telephone call utilizing one of a plurality of different channels within a frequency range, as understood in the art. In one embodiment, the base unit 302 may be configured to provide for local alarm controller functionality, as described herein, in addition to traditional cordless telephone functionality. As shown, the base unit 302 may include an electronic display 306 that may display text for a user to set up sensors within a residence for the forming home security sensing. As shown, the user may set up sensors S1-S7 by naming each of the motion sensors, where the names may be locations in which the sensors are located. In one embodiment, the user may utilize control elements 308 to select a location in which each of the sensors S1-S7 are located from a preestablished list stored in the cordless telephone 300. Alternatively, the user may utilize the control elements 308 and keypad 310 to enter a name or location associated with each of the sensors S1-S7, as understood in the art. The cordless telephone 300 may be preestablished by a manufacturer with each of the different possible locations that a sensor may be assigned (e.g., "master bedroom," "bedroom 1," "bedroom 2," "dining room," "living room," "garage," "shed," and the like). If the user does not want to use the pre-established list of locations in which the sensors may be located, then the user may alternatively enter or rename identifiers associated with the different sensors S1-S7 by selecting letters and numbers, as understood in the art. Although only seven sensors are shown in this list, it should be understood that up to 25 or more sensors may be included to correspond to a maximum number of frequency channels that are available in a frequency range in which the cordless telephone may operate.

Figure 4:
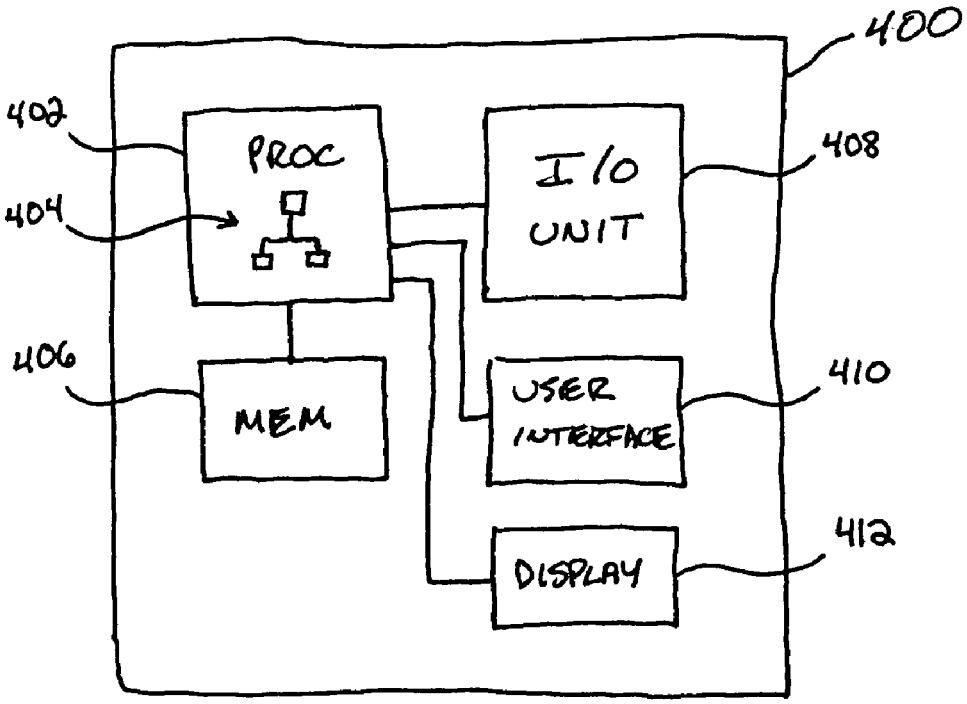
FIG. 4 is a block diagram of an illustrative local alarm controller, which is configured as a separate device or is incorporated into the cordless telephone of FIG. 3, for use in providing a home security system.

With regard to FIG. 4, a block diagram of an illustrative local alarm controller 400 for performing home security monitoring is shown. The local alarm controller 400 may be integrated into a cordless telephone or be a separate unit that operates on one or more telephone lines. The local alarm controller 400 may include a processing unit 402 that executes software 404. The software 404 may be configured to perform home security monitoring functionality in accordance with the principles of the present invention. A processing unit 402 may be in communication with a memory 406, input/output (I/O) unit 408, user interface 410, and electronic display 412. The memory 406 may be configured to store data and software for execution on the processing unit 402. The I/O unit 408 may be configured to communicate over a communications network, such as the PSTN using one or more communications protocols over one or more telephone lines. The I/O unit 408 may further be configured to communicate over cordless communications channels with sensors that communicate over one or more cordless frequency channels using digital and/or analog communications protocols, as understood in the art. The user interface 410 may be configured with control elements or keys and a conventional keypad that enables a user to assign sensors to specific cordless channels, name sensors, review alarm histories, and interface with alarm features as further described herein with regard to FIG. 5. The electronic display 412 may be a conventional or touch screen electronic display utilized on cordless telephones or other electronic devices, as understood in the art.

Figure 5:
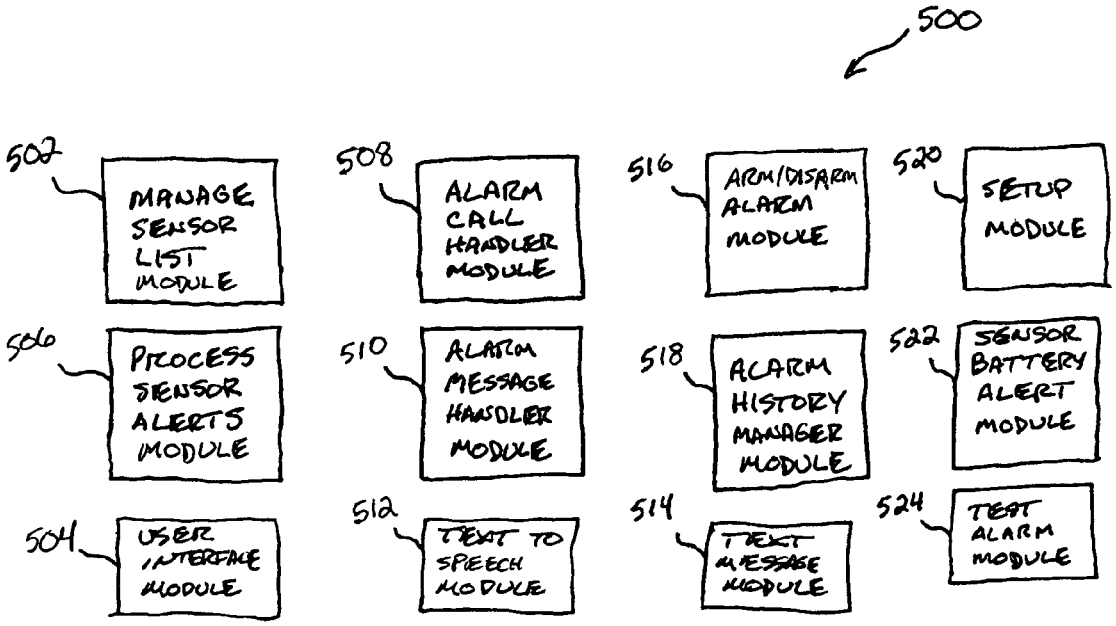
FIG. 5 is a block diagram of illustrative modules executed on the local alarm controller of FIG. 4 for providing home security system functionality in accordance with the principles of the present invention.

With regard to FIG. 5, software modules 500, which may be part of the software 404 of FIG. 4, may be utilized to provide for home security functionality in accordance with the principles of the present invention. The modules 500 may be software and/or hardware to enable a user to establish sensors within a residence or property on which the residence resides at a range that meets cordless telephone communications standards, as understood in the art. It should be understood that the use of cordless telephone communications technologies is but one illustrative embodiment and that other wireless communications technologies may be utilized for providing home security monitoring with the same or analogous functionality as described herein.

A managed sensor list module 502 may be configured to enable a user to manage sensors that are deployed at the residence. The manager sensor list module 502 may be configured to manage a list of sensors and name or associate locations with each of the sensors. TABLE 1 shows a list of sensors that a local alarm controller may utilize to manage sensors.

TABLE 1

| Sensor | Name/Location |
|---|---|
| 1 | Master Bedroom |
| 2 | Bedroom 1 |
| 3 | Bedroom 2 |
| 4 | Kitchen |
| 5 | Living Room |
| 6 | Dining Room |
| 7 | Office |
| 8 | Media Room |
| 9 | Garage |
| 10 | Shed |
| 11 | Hallway |
| 12 | Master Bedroom Window |
| 13 | Bedroom 1 Window |
| 14 | Bedroom 2 Window |
| 15 | Bedroom 3 Window |
| 16 | Living Room Window |
| 17 | Upstairs Window |
| 18 | Downstairs Window |
| 19 | Front Door |
| 20 | Back Door |
| 21 | Garage Door |
| 22 | Other Door |
| 23 | Other Window |
| 24 | Other |
| 25 | Other |

A user interface module 504 may be configured to enable a user to interface with the local alarm controller to set up sensors on particular frequency channels, name sensors, man age alarm history lists, and perform other functionality provided by the modules 500. The user interface module 504 may be configured to enable a user to interact with hard-buttons or soft-buttons depending on whether the local alarm controller uses a touch-screen or non-touch screen electronic display, as understood in the art. The user interface module 504 may further be configured to provide a graphical user interface or text interface to enable the user to navigate through menus, lists, or other user interfaces.

A process sensor alerts module 506 may be configured to process sensor alerts or signals when a sensor senses movement, opening of a window, opening of a door, or otherwise. The process sensor alerts module 506 may, in response to receiving a sensor alert or signal, initiate a process for communicating notice of the sensor alert or signal to a user.

An alarm call handler module 508 may be configured to handle calls to a wireless communications device of a user in response to the process sensor alerts module 506 receiving a sensor signal from a sensor. The alarm call handler module 508 may be configured to access a telephone number stored in a memory assigned to a wireless communications device of a user. In one embodiment, the alarm call handler module 508 may be configured to handle calls to the wireless communications device of a user, and, in response to the wireless communications device not being answered by the user, the alarm call handler module 508 may be configured to access or look up a second telephone number that is assigned to a wireless communications device or other communications device (e.g., work telephone) of the same or different user and call the second telephone number to notify the same or different user of a sensor signal having been detected by the process sensor alerts module 506.

An alarm message handler module 510 may be configured to handle text, e-mail, instant message, or other message communication to the wireless communications device of the user as opposed to a telephone call being placed to the user provided by the alarm call handler module 508. The alarm message handler module 510 may be configured to access an address stored in a memory assigned to the wireless communications device of the user, and communicate a text or other message to the wireless communications device to notify the user of the sensor alert. The alarm call handler module 508 and alarm message handler module 510 may be configured to notify the user of any sensor alert or specific sensor alerts (i.e., specific name or location within a residence in which a sensor is triggered by an intruder).

A text-to-speech module 512 may be configured to convert text into speech, as understood in the art, to notify a user of a wireless communications device of a sensor alert triggered by an intruder in the user's residence. The text-to-speech module 512 may be utilized to place a conventional call to the user of the wireless communications device in the event that the wireless communications device is incapable of handling text messages or the user desires to receive telephone calls as opposed to text messages.

A text message module 514 may be configured to prepare and communicate text messages to a wireless communications device of the user in response to the alarm message handler module 510 receiving a sensor signal to communicate a message of an alarm event to a wireless communications device. The text message module 514 may be provided with a specific message to communicate to the wireless communications device of the user from the alarm message handler module 510. For example, the text message module 514 may be configured to communicate a message indicative of a specific sensor and location of the sensor (e.g., "Master Bedroom") based on the information associated with the sensors as provided in TABLE 1.

An arm/disarm alarm module 516 may be configured to enable a user of the local alarm controller to arm and disarm the home security system. In one embodiment, the arm/disarm alarm module 516 is configured to receive an input from the local alarm controller from a user pressing a hard-button or soft-button. The arm/disarm alarm module 516 may further be configured to enable the user to remotely place a call to the local alarm controller and enter a code or respond to an audible menu via an interactive voice response (IVR) system to arm or disarm the home security system.

An alarm history manager module 518 may be configured to enable the user to access a list of alarms that have occurred in the past. In one embodiment, the alarm history manager module 518 may be configured to store the past history of alarms that have occurred and sort the alarms by date, sensors, or any other alarm trigger.

A setup module 520 may be configured to enable a user to set up the local alarm controller by establishing locations within a residence for each of the sensors, primary and secondary telephone numbers for the local alarm controller to call in the event of a sensor alert, text message addresses, e-mail addresses, instant message addresses, or any other addresses associated with a primary and secondary wireless communications device for communicating an alert to a wireless communications device of a user. The setup module 520 may further be configured to enable the user to establish a current time and date, as understood in the art. The setup module 520 may further be configured to activate and deactivate particular communication channels that the sensors may communicate with the local alarm controller.

A sensor battery alert module 522 may be configured to sense battery status of sensor. In one embodiment, the sensors may communicate a battery alert signal to the local alarm module and the sensor battery alert module 522 may, in response to receiving the battery alerts, generate a message on electronic display of the local alarm controller, generate an indication light, generate a tone, communicate a text message or other message to the wireless communications device of the user, or generate a telephone call to the wireless communications device to notify the user of the sensor battery that is low. In one embodiment, the sensor battery alert module 522 may notify the user of the specific sensor based on the location of the sensor using the information of TABLE 1, for example.

A test alarm module 524 may be configured to enable a user to test the alarm by manually selecting a hard-button or soft-button to cause the local alarm controller to place a call using a speed-dial function to call the wireless communications device of the user or communicate a text message or other message to the wireless communications device of the user. In one embodiment, a menu may be provided for the user to select a particular message to be communicated to the user, thereby ensuring that the local alarm controller functions properly and has correct communication information for communicating alarm messages to the user. It should be understood that the modules 500 shown may be combined or otherwise configured to provide for the functionality, as described herein.

Figure 6:
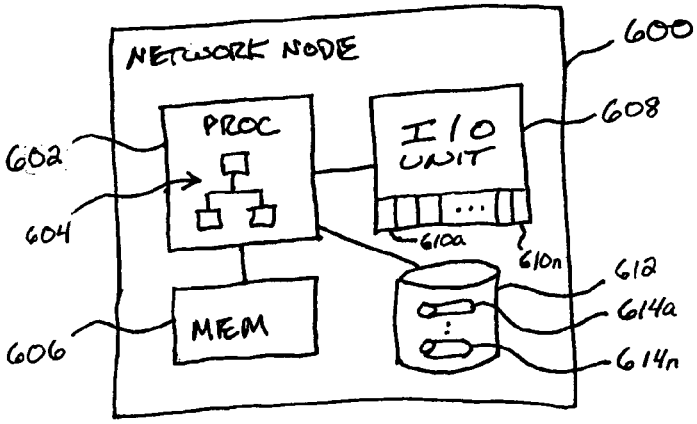
FIG. 6 is a block diagram of illustrative network node that may be operating on a communications network for providing home security system monitoring in conjunction with a local alarm controller.

With regard to FIG. 6, a network node 600 that operates on a communications network, such as the PSTN, may include a processing unit 602 that executes software 604. The processing unit 602 may be in communication with a memory 606, I/O unit 608 that may utilize one or more input/output modules 610*a*-610*n* (collectively 610), and storage unit 612. The storage unit 612 may be configured to store one or more data repositories 614*a*-614*n* (collectively 614). The software 604 may be configured to provide for home security system services and act as a conduit between a local alarm controller and wireless communications device of a user (see FIG. 2). The software may perform various home security functionality that is the same or different from that of the local alarm controller, as previously described. The memory 606 may be configured to store data and software to assist in providing alarm notifications to the user in response to receiving an alarm notification from the local alarm controller. The I/O unit 608 may be configured to communicate over a communications network, such as the PSTN. The I/O modules 610 may each be configured with a fined telephone number or be dynamically controlled to operate over a communications line with a telephone number so that a communication from the network node to a wireless communications device will show a particular telephone number as a caller ID by the wireless communications device. The data repositories 614 may be configured to store information associated with users who subscribe to a communications service provider for use of the home security system. The data repositories may be configured as databases, as understood in the art. The data stored in the data repositories 614 may include information that is established by the users, which may include location of each of the sensors within a residence. TABLE 2 shows an illustrative sensor configuration within a home of a user. Each sensor may be associated with a particular telephone number that the network node utilizes to dial from in response to receiving an alarm signal from a local alarm controller in a residence that is indicative of a sensor within the residence issuing a sensor signal or trigger.

TABLE 2

| Sensor | Telephone Number | Location |
|---|---|---|
| 0 | 214-555-5000 | Home Alarm |
| 1 | 214-555-5001 | Master Bedroom |
| 2 | 214-555-5002 | Bedroom 1 |
| 3 | 214-555-5003 | Bedroom 2 |
| 4 | 214-555-5004 | Bedroom 3 |
| 5 | 214-555-5005 | Kitchen |
| 6 | 214-555-5006 | Living Room |
| 7 | 214-555-5007 | Dining Room |
| 8 | 214-555-5008 | Office |
| 9 | 214-555-5009 | Media Room |
| 10 | 214-555-5010 | Garage |
| 11 | 214-555-5011 | Shed |
| 12 | 214-555-5012 | Hallway |
| 13 | 214-555-5013 | Master Bedroom Window |
| 14 | 214-555-5014 | Bedroom 1 Window |
| 15 | 214-555-5015 | Bedroom 2 Window |
| 16 | 214-555-5016 | Bedroom 3 Window |
| 17 | 214-555-5017 | Living Room Window |
| 18 | 214-555-5018 | Upstairs Window |
| 19 | 214-555-5019 | Downstairs Window |
| 20 | 214-555-5020 | Front Door |
| 21 | 214-555-5021 | Back Door |
| 22 | 214-555-5022 | Garage Door |
| 23 | 214-555-5023 | Other Door |
| 24 | 214-555-5024 | Other Window |
| 25 | 214-555-5025 | Other |

As shown in TABLE 2, sensor 0 having telephone number 214-555-5000 may be utilized in cases where the user simply wants to know that an alarm has been triggered in his or her house and does not care which sensor was triggered. In other words, if an alarm signal is received by the network node 600 from a local alarm controller from a user's home, the network node 600, in response to receiving the alarm signal, may call the user's wireless communications device from telephone number 214-555-5000 if the user sets up the network node 600 to provide a generic alarm call or message. The user's wireless communications device may display a contact name of "home alarm" or other contact name that the user assigns with the telephone number 214-555-5000. In an alternative embodiment, if the user has the desire to know which specific sensor is triggered, then the local alarm controller may be configured to call the network node 600 and communicate a sensor number or other indicia in a data packet, tone, or other signal that the network node 600 may process to determine which sensor has been triggered. In response to receiving the sensor number, the processing unit 602 may utilize an I/O module 610*a*, for example, to dial the wireless communications device of the user with a telephone number (e.g., 214-555-5001), thereby enabling the wireless communications device to display a contact name associated with that telephone number that the user has preprogrammed in his or her telephone so that he or she can be instantly alerted and know which sensor has been triggered (e.g., "master bedroom"). The ability to establish multiple telephone lines (e.g. 25 telephone lines) using the network node 600 may be a solution that is easier to provide for notifying a generic or off-the-shelf wireless communications device (e.g., mobile telephone).

The alternative may be to provide the user with multiple telephone lines (e.g., 10 telephone lines) that the local alarm controller may utilize to call the wireless communications device depending on a sensor that is triggered, thereby enabling the user to readily identify which sensor has been triggered. The drawback with such a configuration is that the user is provided with many telephone lines. By providing the multiple telephone line functionality within network node 600, the user simply needs a single telephone line and the local alarm controller may communicate which sensor has been triggered to the network node 600 for determining the triggered sensor and placing a call from the network node 600 to the user. In either case, the user may set up a contact list with multiple telephone lines or numbers that, when a call is received from the telephone number, the wireless communications device displays the contact name (e.g., location within the house) that the user has associated with the telephone number. Another embodiment may provide for a software application to be operating on a wireless communications device of the user that is capable of receiving a call from a local alarm controller with a particular telephone number and data that indicates which sensor has been triggered so as to display a sensor identifier or associated location within the residence of the sensor.

Figure 7:
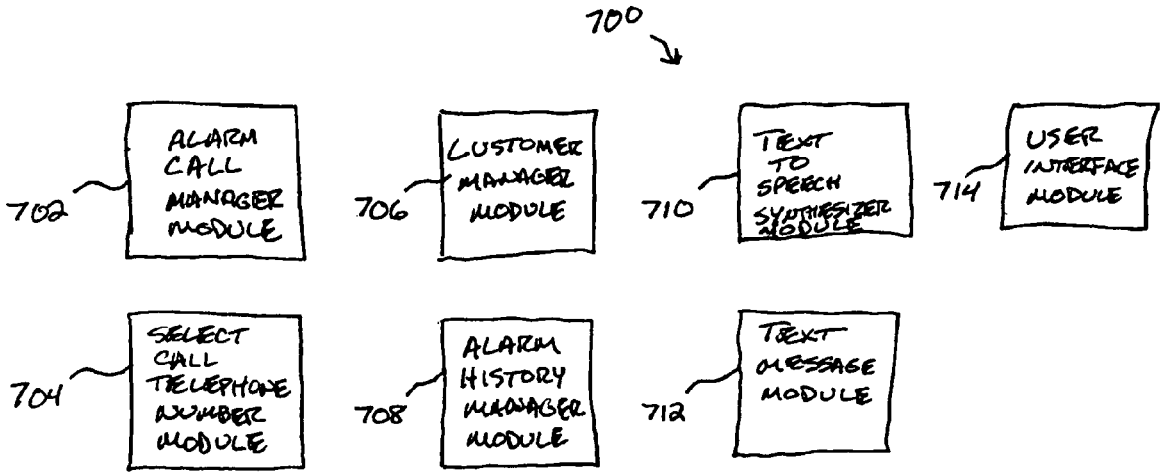
FIG. 7 is a block diagram of illustrative modules that may be executed on the network node of FIG. 6 to provide for home security services.

With regard to FIG. 7, modules 700 may be configured to be executed on the network node 600 to provide for home security notification, as described herein. The modules may include an alarm call manager module 702 that is configured to receive a call from a local alarm controller indicating that a sensor has been triggered. In one embodiment, the alarm call manager module 702 is configured to receive a sensor number or other indicia that represents a particular sensor that has been triggered. In an alternative embodiment, the alarm call manager module 702 may be configured to simply identify that an alarm call has been received from a particular residence and not include the particular sensor that has been triggered.

A select call telephone number module 704 may be configured to select a particular telephone number from which to place a call from the network node. The select call telephone number module 704 may be configured to receive the number of the sensor or other indicia of the sensor received by the alarm call manager module 702 and select a telephone number from which to place the call to the wireless communications device of the user. In one embodiment, if the telephone numbers are dedicated to particular I/O modules, then the select call telephone number module 704 may select to place a call from a particular I/O module. Alternatively, if the I/O modules are not dedicated with telephone numbers, then the select call telephone number module 704 may select a telephone number and utilize an available I/O module to place the call using that telephone number to the wireless communications device of the user.

A customer manager module 706 may be configured to manage customers or users of home security systems that utilize a local alarm controller, as described herein. The customer manager module 706 may be configured to store names, telephone numbers, addresses, alarm information (e.g., TABLE 2), and other information associated with customers that utilize a home security system.

An alarm history manager module 708 may be configured to store information of alarms that have been received and communicated to a wireless communications device of a user. The alarm history manager module 708 may be configured to enable a user to access the history of alarms that have been triggered.

A text-to-speech synthesizer module 710 may be configured to convert text to speech when placing a call to a wireless communications device of a user. The text may be generated from accessing information associated with a sensor, such as "master bedroom alarm," or other information that the network node may utilize to call and notify a user of an alarm at his or her residence.

A text message module 712 may be configured to deliver text to a customer rather than generate a synthesized voice message. The text message module 712 may utilize information being managed by the customer manager module 706 that provides addresses to the wireless communications device of the user or other electronic address, such as an e-mail address.

A user interface module 714 may be configured to enable a user to access information stored at the network node. The information may include customer information, alarm sensor information (e.g., locations within a house of the sensors), contact information, times of day calling or routing information to direct a call or message to one or more different communications devices of the user in the event of an alarm being triggered, or other information. The user interface module 714 may be configured to provide for a graphical user interface, such as a website, for the user to interact to access his or her information and set up different information for the user to receive calls or alerts from the local alarm controller.

Figure 8A:
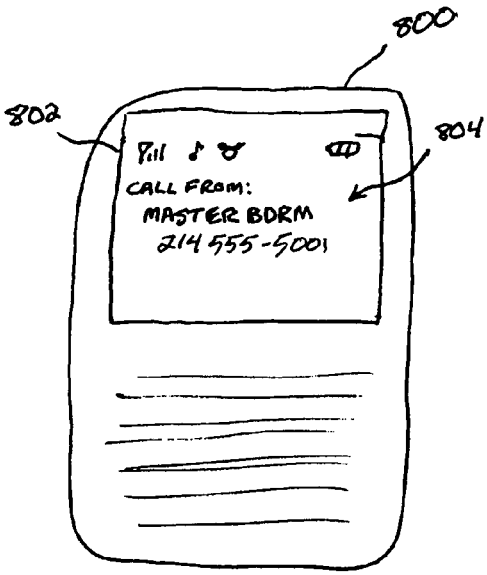
FIGS. 8A and 8B are illustrations of illustrative wireless communications devices that may be utilized to receive notifications from a home security system to notify a user of a breach at a home.
Figure 8B:
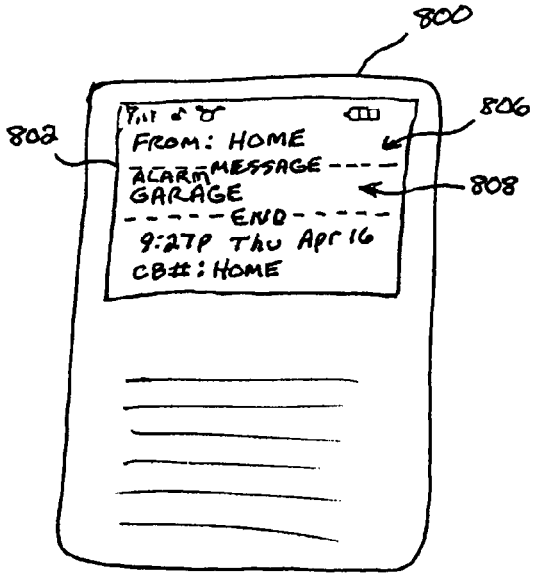

With regard to FIGS. 8A and 8B, an illustrative wireless communications device 800 is shown. In one embodiment, the wireless communications device 800 is a mobile telephone. Alternatively, the wireless communications device 800 may be a smart telephone, such as an iPhone®, or other wireless communications device, as understood in the art. The wireless communications device 800 may include an electronic display 802 that is a conventional electronic display or touch screen display, that enables a user to view information, such as caller information that displays a contact name (e.g., "master bdrm") and telephone number from which the call is being received (e.g., 214-555-5001). Alternatively, the communication from the local alarm controller or network node may be a text message 806 that displays a location (e.g., "alarm garage") that the local alarm controller or network node generates to notify the user of which specific sensor was triggered.

Figure 9:
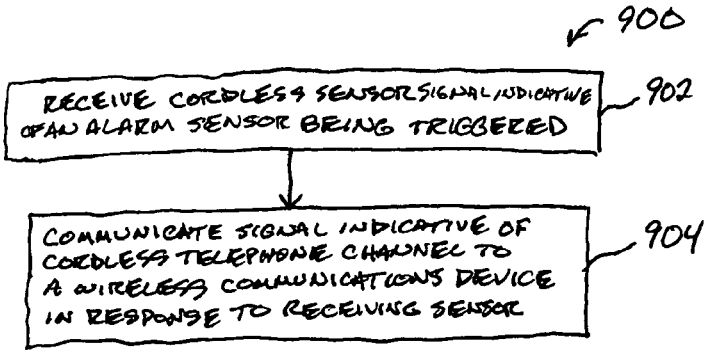
FIG. 9 is a flow chart of an illustrative process for providing home security services.

With regard to FIG. 9, a process for providing home security services is shown. The process starts at step 902, where a cordless sensor signal indicative of an alarm sensor being triggered is received at a local alarm controller. The cordless sensor signal may be over one of multiple cordless telephone channels. In response to receiving the sensor signal at step 902, a signal indicative of the cordless telephone channel may be communicated to a wireless communications device of a user to notify the user that a sensor associated with the cordless telephone channel was triggered.

The previous detailed description is of a small number of embodiments for implementing the invention and is not intended to be limiting in scope. One of skill in this art will immediately envisage the methods and variations used to implement this invention in other areas than those described in detail. The following claims set forth a number of the embodiments of the invention disclosed with greater particularity.

What is claimed:

1. A method for providing home security services, said method comprising:

providing a plurality of individual alarm sensors;

associating each individual alarm sensor with a particular telephone number which particular telephone number is distinct from the particular telephone number associated with any other individual alarm sensor;

receiving, at a local alarm controller, a cordless sensor signal indicative of an alarm sensor being triggered; and in response to receiving the sensor signal, communicating an alarm signal from the local alarm controller to a mobile telephone of a user, wherein the local alarm controller dials from the particular telephone number associated with the triggered sensor to communicate with the mobile telephone of a user and wherein communicating with the mobile telephone of the user is performed without routing information to a central security monitoring service.

2. The method according to claim 1, wherein the local alarm controller is integrated into a cordless telephone base unit, the cordless telephone base unit providing a docking station for a cordless telephone for use with the cordless telephone base unit.

3. The method according to claim 1, wherein communicating an alarm signal includes:

accessing a telephone number assigned to the mobile telephone number; and placing a call to the mobile telephone using the telephone number.

4. The method according to claim 3, further comprising communicating an audible message to the user in response to the user answering the call.

5. The method according to claim 3, further comprising selecting a telephone line from which to place the call.

6. The method according to claim 1, wherein communicating an alarm signal includes communicating a text message.

7. The method according to claim 1, wherein communicating an alarm signal includes:

accessing a telephone number assigned to a network node; and calling, by the network node, a telephone number assigned to the mobile telephone.

8. The method according to claim 1, further comprising communicating a cordless telephone channel identifier to the network node, and wherein the network node is further configured to select a telephone number from among a plurality of telephone numbers to call the mobile telephone.

9. The method according to claim 1, further comprising:

determining that the user does not answer the call; and communicating the signal to a different mobile telephone to notify the same or different another user that a sensor associated with the cordless telephone channel was triggered.

10. A home security system, comprising:

a plurality of individual alarm sensors wherein each individual alarm sensor is associated with a particular telephone number, which particular telephone number is distinct from the particular telephone number associated with any other individual alarm sensor; and a local alarm controller configured to communicate with the plurality of alarm sensors and further configured to initiate communications with a wireless communications device by dialing from the particular telephone number associated with a triggered alarm sensor in response to receiving an alarm signal from the triggered sensor, wherein the local alarm controller communicates with the wireless communications device via a communications network without routing information to a central security monitoring service.

11. The home security system according to claim 10, wherein said local alarm controller is integrated into a cordless telephone base unit, the cordless telephone base unit providing a docking station for a cordless telephone for use with the cordless telephone base unit.

12. The home security system according to claim 10, wherein the communication is a communication to a network node that is configured to communicate an alarm signal to the wireless communications device.

13. The home security system according to claim 10, wherein the communication with the mobile telephone is a telephone call to the wireless communications device and, wherein said local alarm controller is further configured to communicate an audible signal to indicate which sensor was triggered.

14. The home security system according to claim 10, wherein the communication is a text message.

* * * * *